US009445627B2

(12) United States Patent
Beroth et al.

(10) Patent No.: US 9,445,627 B2
(45) Date of Patent: Sep. 20, 2016

(54) TOBACCO ROD MANUFACTURING APPARATUS

(75) Inventors: Roger Allen Beroth, Dobson, NC (US); Elwood Dale Scott, Jr., Pinnacle, NC (US); Timothy Franklin Tilley, Pinnacle, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 1721 days.

(21) Appl. No.: 12/766,377

(22) Filed: Apr. 23, 2010

(65) Prior Publication Data

US 2011/0259351 A1 Oct. 27, 2011

(51) Int. Cl.

| | |
|---|---|
| ***A24C 5/10*** | (2006.01) |
| ***A24C 1/26*** | (2006.01) |
| ***A24C 5/18*** | (2006.01) |

(52) U.S. Cl.

CPC ..... *A24C 5/18* (2013.01)

(58) Field of Classification Search

None

See application file for complete search history.

(56) References Cited

U.S. PATENT DOCUMENTS

| | | | | |
|---|---|---|---|---|
| 3,288,147 | A | 11/1966 | Molins et al. | |
| 3,915,176 | A | 10/1975 | Heitmann et al. | |
| 4,185,644 | A | 1/1980 | Heitmann et al. | |
| 4,235,248 | A | 11/1980 | Schumacher | |
| 4,291,713 | A | 9/1981 | Frank | |
| 4,474,190 | A * | 10/1984 | Brand | 131/84.1 |
| 4,574,816 | A | 3/1986 | Rudszinat | |
| 4,736,754 | A | 4/1988 | Heitmann et al. | |
| 4,781,203 | A | 11/1988 | La Hue | |
| 4,844,100 | A | 7/1989 | Holznagel | |
| 4,878,506 | A | 11/1989 | Pinck et al. | |
| 5,012,823 | A | 5/1991 | Keritsis et al. | |
| 5,060,665 | A | 10/1991 | Heitmann | |
| 5,072,742 | A | 12/1991 | Heitmann | |
| 5,156,169 | A | 10/1992 | Holmes et al. | |
| 5,191,906 | A | 3/1993 | Myracle, Jr. | |

(Continued)

FOREIGN PATENT DOCUMENTS

| | | |
|---|---|---|
| DE | 42 15 059 | 11/1993 |
| EP | 1281329 A2 | 1/2002 |

(Continued)

OTHER PUBLICATIONS

International Search Report and Written Opinion of the International Searching Authority issued in corresponding International Application No. PCT/US2011 033433.

*Primary Examiner* — Michael H Wilson
*Assistant Examiner* — Phu Nguyen
(74) *Attorney, Agent, or Firm* — Womble Carlyle Sandridge & Rice LLP

(57) ABSTRACT

An apparatus is provided for forming tobacco rod portions of a smoking article. A conveyor unit is configured to receive a continuous stream of the tobacco material and to transport the continuous tobacco material stream along an elongate path for formation of the continuous tobacco material stream into a continuous tobacco rod, wherein the conveyor unit is housed in a conveyor housing. A suction system is in fluid communication with the conveyor housing through a suction port and is configured to apply suction to the conveyor housing via the suction port so as to draw the continuous tobacco stream into engagement with the conveyor unit. A wear resistant member is engaged with a wall of the conveyor housing and defines the suction port, wherein the wear resistant member is configured to resist wear from interaction with particles associated with the tobacco material.

10 Claims, 6 Drawing Sheets

(56) References Cited

U.S. PATENT DOCUMENTS

| | | | | |
|---|---|---|---|---|
| 5,220,930 | A | 6/1993 | Gentry | |
| 6,186,315 | B1 | 2/2001 | Schmick | |
| 6,360,751 | B1 | 3/2002 | Fagg et al. | |
| 6,647,870 | B2 | 11/2003 | Kohno | |
| 6,779,530 | B2 | 8/2004 | Kraker | |
| 6,848,449 | B2 | 2/2005 | Kitao et al. | |
| 6,904,917 | B2 | 6/2005 | Kitao et al. | |
| 7,210,486 | B2 | 5/2007 | Hartmann | |
| 7,234,471 | B2 * | 6/2007 | Fitzgerald et al. | 131/365 |
| 7,237,559 | B2 | 7/2007 | Ashcraft et al. | |
| 7,275,548 | B2 | 10/2007 | Hancock et al. | |
| 7,281,540 | B2 | 10/2007 | Barnes et al. | |
| 7,565,818 | B2 | 7/2009 | Thomas et al. | |
| 2002/0014243 | A1 * | 2/2002 | Muller et al. | 131/84.3 |
| 2003/0136419 | A1 | 7/2003 | Muller | |
| 2005/0066986 | A1 | 3/2005 | Nestor et al. | |
| 2007/0246055 | A1 | 10/2007 | Oglesby | |

FOREIGN PATENT DOCUMENTS

| | | | |
|---|---|---|---|
| EP | 1169926 | A1 | 2/2003 |
| EP | 1 925 219 | | 5/2008 |
| GB | 974821 | | 11/1964 |
| JP | 61124409 | | 6/1986 |
| JP | 2001511367 | | 8/2001 |
| JP | 200251760 | | 2/2002 |
| JP | 200335156 | | 2/2003 |
| JP | 2009539389 | | 11/2009 |

* cited by examiner

TOBACCO ROD MANUFACTURING APPARATUS

BACKGROUND OF THE INVENTION

1. Field of the Invention

The present invention relates to products made or derived from tobacco, or that otherwise incorporate tobacco, and are intended for human consumption. In particular, embodiments of the present invention relate to apparatuses for manufacturing tobacco rods, and smoking articles incorporating such tobacco rods, and, more particularly, to apparatuses for forming tobacco rod portions of a smoking article, such as a cigarette.

2. Description of Related Art

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Specifically designed machinery is employed for the production and/or processing of cigarettes and/or other types of rod-shaped articles which constitute or form part of smoking articles. More particularly, tobacco rod-shaped articles are produced by drawing a relatively thin but wide continuous layer of tobacco particles from a suitable source and converting the layer into a narrow continuous stream which moves lengthwise, draping the stream into a web of cigarette paper or the like to form a wrapped stream or rod, and severing the rod at selected intervals so that the rod yields a succession of rod-shaped sections (e.g., plain cigarettes) of unit length or multiple unit length. Such steps can be carried out in a cigarette maker or another machine wherein a distributor contains a supply of tobacco particles and is capable of forming the layer, converting the layer into a narrow stream, trimming the stream, draping the trimmed stream (filler), and converting the resulting rod into discrete rod-shaped articles. Typically, the stream and the filler are attracted by suction to one or more foraminous belt conveyors so as to remain in the prescribed path and advance at the speed of such conveyor or conveyors.

However, the tobacco material moving throughout the cigarette making machinery may cause wear issues on various components thereof. For example, tobacco material carried via suction created by a suction system for attracting the tobacco material to the conveyor(s) may have an erosive effect on components associated with the conveyor(s) and/or conveyor system(s) and/or suction system(s). Such wear issues typically lead to downtime associated with the machine to allow for repairs, which can be costly and time consuming.

As such, it would be desirable to provide cigarette making machinery capable of withstanding various wear issues associated therewith, thereby reducing instances of downtime for repairing such machinery.

BRIEF SUMMARY OF THE INVENTION

The above and other needs are met by the present invention which, according to one aspect, provides an apparatus for forming tobacco rod portions of a smoking article from tobacco material. The apparatus comprises a conveyor unit configured to receive a continuous stream of the tobacco material and to transport the continuous tobacco material stream along an elongate path for formation of the continuous tobacco material stream into a continuous tobacco rod. The apparatus further comprises a conveyor housing configured to house the conveyor unit. The apparatus further comprises a suction system in fluid communication with the conveyor housing through a suction port and configured to apply suction to the conveyor housing via the suction port so as to draw the continuous tobacco stream into engagement with the conveyor unit. The apparatus further comprises a wear resistant member operably engaged with a wall of the conveyor housing and defining the suction port. The wear resistant member is configured to resist wear from interaction with particles associated with the tobacco material, wherein the particles are drawn through the suction port by the suction system.

Embodiments of the present invention thus provide advantages as otherwise detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 5A:
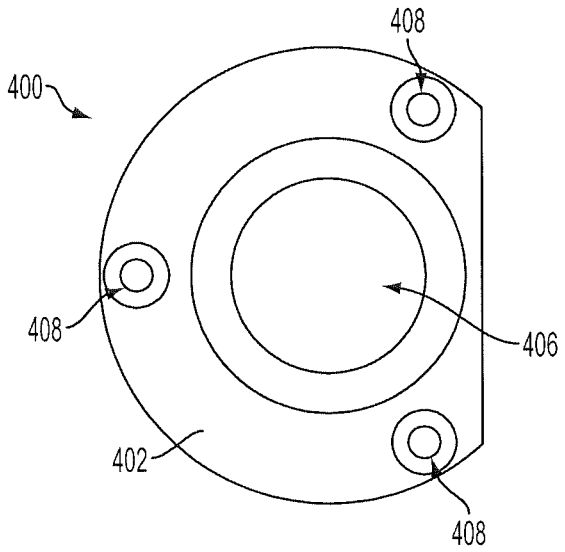
Figure 5B:
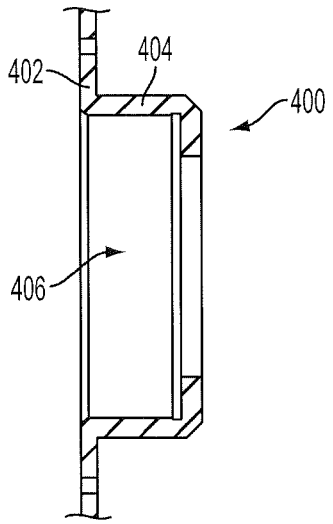
Figure 6:
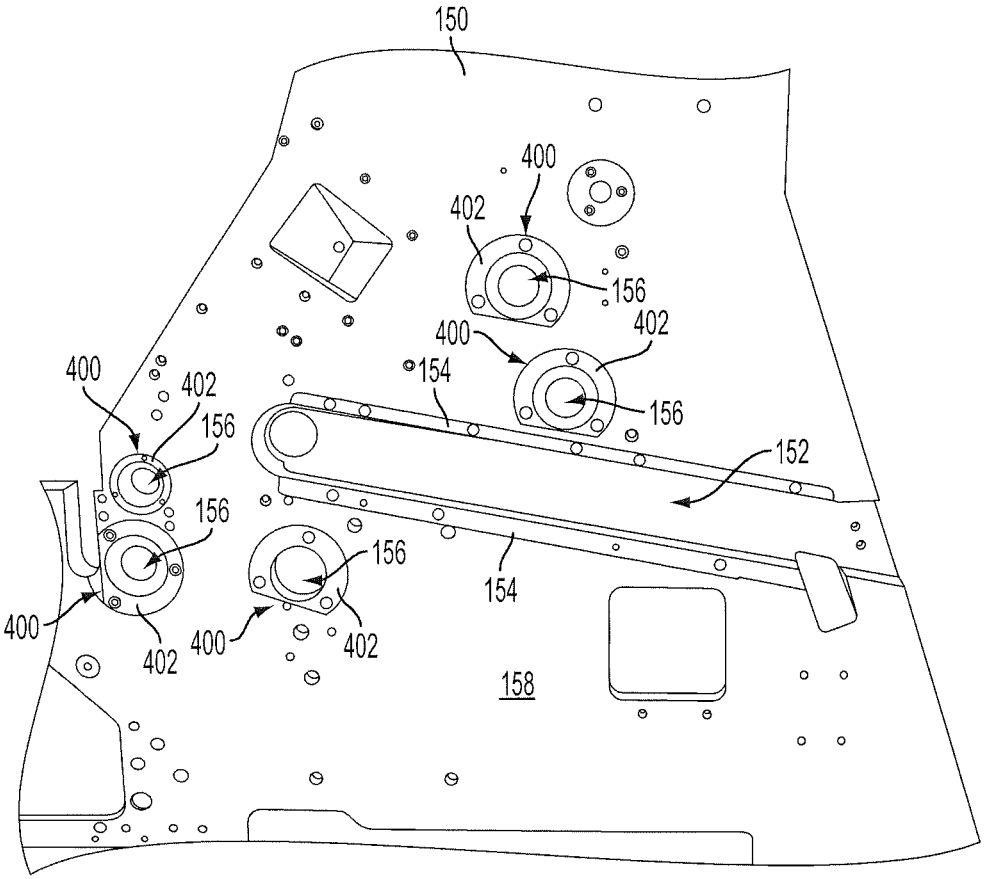

FIGS. 5A and 5B are front and cross-section schematic views, respectively, of a bearing support member capable of implementation with a tobacco supply unit of a tobacco rod making apparatus, according to one embodiment of the present invention; and FIG. 6 is a perspective view of a side wall of a tobacco rod making apparatus, the side wall having a plurality of bearing support members and a channel member engaged therewith to provide wear resistance, according to one embodiment of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Cigarette rods are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; U.S. Pat. No. 6,904,917 to Kitao et al.; U.S. Pat. No. 7,210,486 to Hartmann; U.S. Pat. No. 7,234,471 to Fitzgerald et al.; U.S. Pat. No. 7,275,548 to Hancock et al.; and U.S. Pat. No. 7,281,540 to Barnes et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Patent Application Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Various types of cigarette components, including tobacco types, tobacco blends, top dressing and casing materials, blend packing densities; types of paper wrapping materials for tobacco rods, types of tipping materials, and levels of air dilution, can be employed. See, for example, the various representative types of cigarette components, as well as the various cigarette designs, formats, configurations and characteristics, which are set forth in U.S. Pat. No. 5,220,930 to Gentry; U.S. Pat. No. 6,779,530 to Kraker; U.S. Pat. No. 7,237,559 to Ashcraft et al.; and U.S. Pat. No. 7,565,818 to Thomas et al.; and U.S. Patent Application Publication Nos. 2005/0066986 to Nestor et al.; and 2007/0246055 to Oglesby; each of which is incorporated herein by reference.

Figure 1:
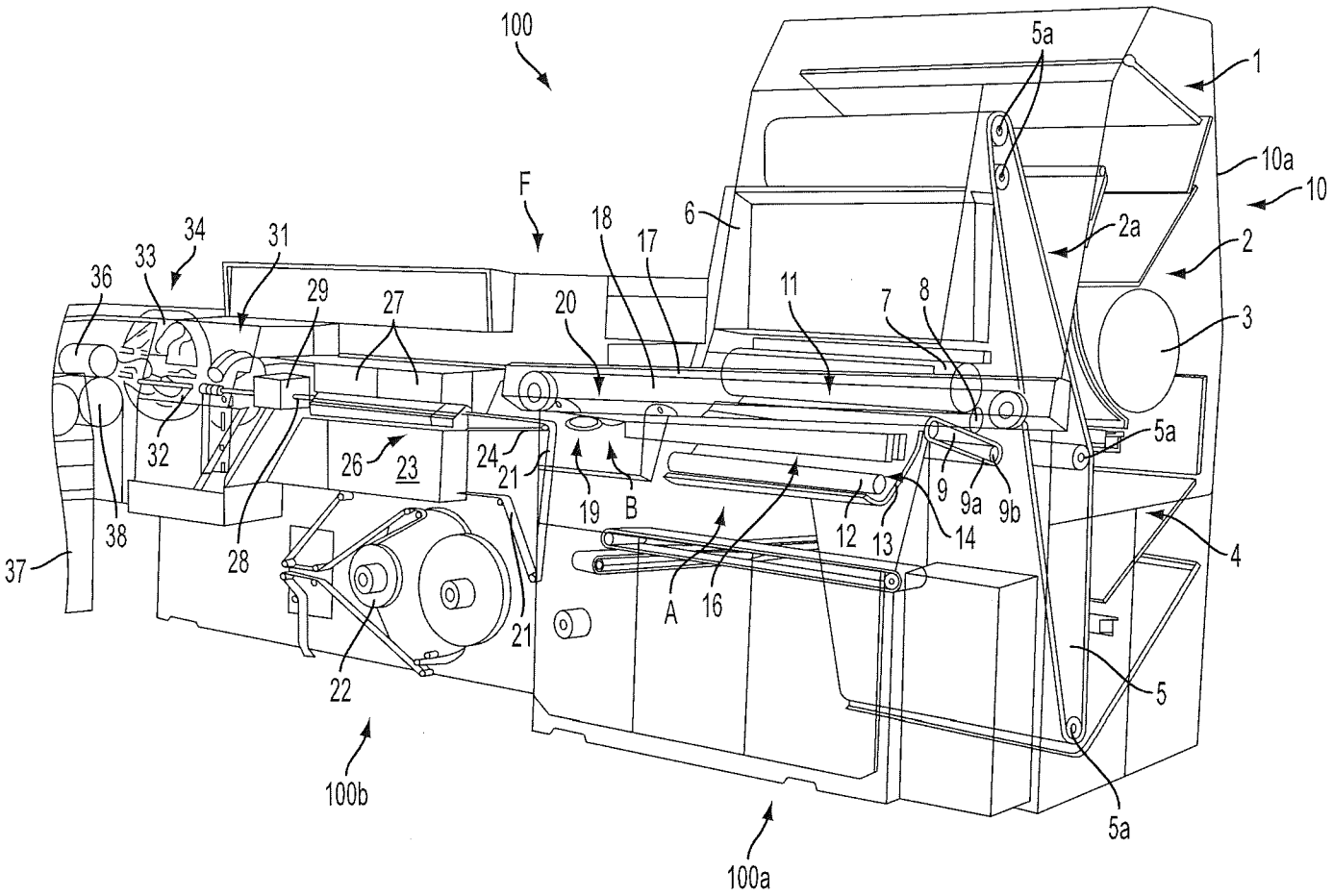
FIG. 1 is a schematic perspective view of a tobacco rod making apparatus, according to one embodiment of the present invention, and further showing a portion of a filter tipping machine which receives tobacco rod portions from the tobacco rod making apparatus.

FIG. 1 shows schematically a tobacco rod making apparatus 100, which cooperates with a filter tipping apparatus 37. The tobacco rod making apparatus 100 may be configured to deliver rod-shaped smoking articles (tobacco rod portions) 32 to the filter tipping apparatus 37. The illustrated tobacco rod making apparatus 100 can be of the type known as PROTOS which is manufactured and distributed by Hauni-Werke Körber & Co. KG, wherein a tobacco stream forming portion 100*a* is known as VE 80 and a cigarette wrapping portion 100*b* is known as SE 80. The filter tipping apparatus 37 may be of the type known as MAX 80 (manufactured and distributed by Hauni-Werke Körber & Co. KG).

According to one embodiment, the tobacco rod making apparatus 100 may comprise a tobacco supply unit 10 having a tobacco material supply housing 10*a* with a frame F wherein a pivotable gate 1 is actuatable to admit batches of tobacco material from the discharge end of a delivery system (not shown), such as a pneumatic conveyor, into a first or primary distributor 2 which contains a substantial supply of tobacco material and whose bottom wall comprises a rotary drum-shaped carded conveyor unit 3 serving to transfer metered quantities of tobacco material into a reservoir 4 of a second or main distributor 2*a*. One side wall of the reservoir 4 comprises the upwardly moving reach of an endless belt conveyor unit 5 of the second distributer 2*a* having equidistant pockets (not shown) serving to withdraw batches of tobacco material from the supply in the reservoir 4 and to dump such batches seriatim through the open upper end of a source of fibrous material, shown as an upright duct 6. The manner in which the conveyor unit 5 draws batches of tobacco particles from the reservoir 4 and the manner in which such batches are dumped into the duct 6 are disclosed by, for example, U.S. Pat. No. 4,185,644 to Heitmann et al. and U.S. Pat. No. 4,235,248 to Schumacher. A variable-speed drum-shaped carded conveyor unit 7 withdraws tobacco particles at a variable rate from the bottom of the column of tobacco material in the duct 6 and cooperates with a rapidly rotating picker roller device 8, which expels the particles from the carding of the carded conveyor unit 7 and showers them onto the upper reach of an apron conveyor device 9 driven at a constant speed.

The tobacco supply unit 10 supplies tobacco material to the apron conveyor device 9. The tobacco stream which is expelled from the carding of the carded conveyor unit 7 may be uniform and forms on the upper reach of the apron conveyor device 9 a wide carpet whose leading end is propelled against a substantially vertical curtain 66 (FIG. 2) of compressed air issuing from a plenum chamber 67 whose inlet is connected to the pressure side of a blower device 68. The plenum chamber 67 and the blower device 68 comprise component parts of a tobacco sifting or classifying device 11. Heavier particles of tobacco penetrate through the curtain 66 and accumulate in an intercepting vessel 69*a* containing a rotating feed screw 69 which evacuates the accumulated heavier particles, either periodically or continuously. The heavier particles include fragments of tobacco ribs, birds' eyes and like parts. The lighter tobacco material (primarily shreds of tobacco leaf laminae) are deflected by the air jets of the curtain 68 and enter a funnel 14 which is defined by an arcuate wall 13 and a rotary drum-shaped carded conveyor unit 12. The carding of the rotary drum-shaped carded conveyor unit 12 propels the lightweight tobacco particles against the underside of the lower reach of an endless air-permeable belt conveyor unit 17 housed by a conveyor housing 18.

Figure 2:
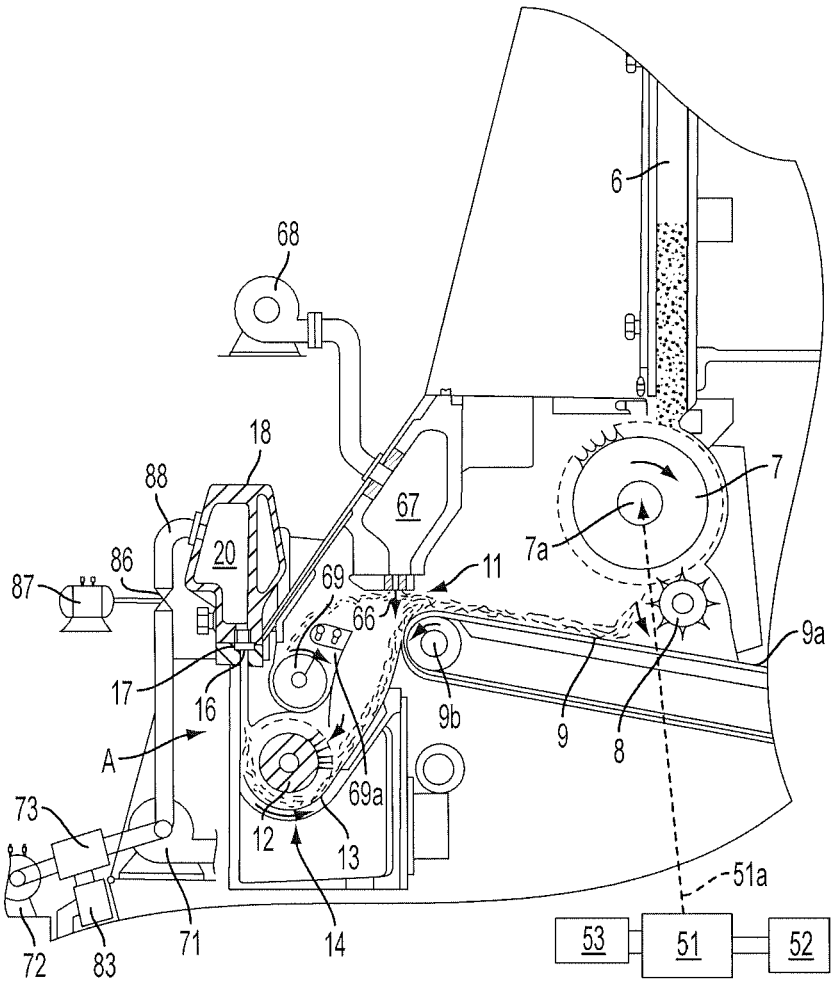
FIG. 2 is a schematic cross-sectional side view of the tobacco rod making apparatus of FIG. 1.

FIG. 2 illustrates a portion of the tobacco rod making apparatus 100 which is shown in FIG. 1, namely the parts which transport and influence tobacco particles between the duct 6 (source of fibrous material) and the stream building zone A in a tobacco material inlet duct 16 at the underside of the lower reach of the air-permeable belt conveyor unit 17. The carded drum-shaped conveyor unit 7 comprises a variable-speed tobacco feeding device whose shaft 7*a* is driven by a constant-speed or variable-speed prime mover 52 (e.g., the main prime mover of the cigarette rod making machine) through a variable-speed transmission 51. The operative connection 51*a* between the output element of the transmission 51 and the shaft 7*a* is indicated by a straight phantom line. For example, such operative connection can constitute the output element of the transmission 51. The ratio of the transmission 51 is adjustable by a servomotor 53 in indirect response to changes in the characteristics of (first) signals which are generated by the ionization chamber of the density monitoring device 29.

Figure 3:
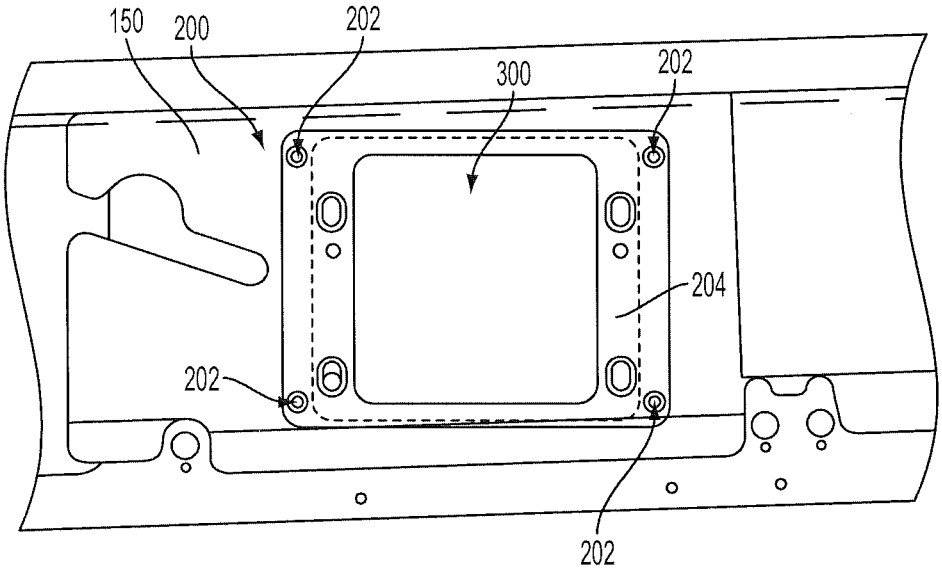
FIG. 3 is a fragmentary schematic view of a conveyor unit for a tobacco rod making apparatus, the conveyor unit having a wall with a wear resistant member defining a suction port, according to one embodiment of the present invention.
Figure 4A:
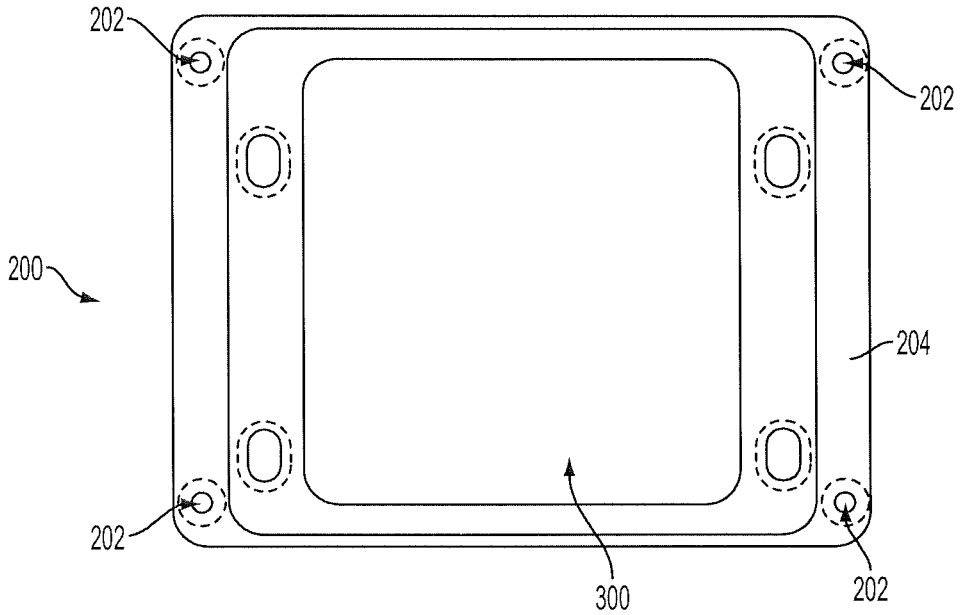
FIGS. 4A-4C are various schematic views of a wear resistant member capable of being implemented in a conveyor unit of a tobacco rod making apparatus, according to one embodiment of the present invention.
Figure 4B:
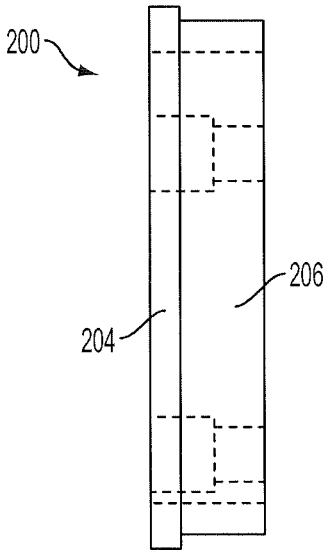
Figure 4C:
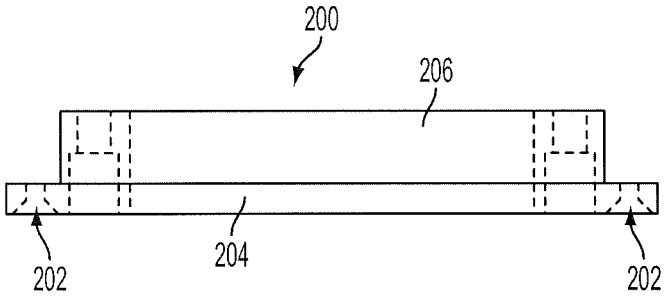

The upper side of the lower reach of the conveyor unit 17 is adjacent to the air-permeable bottom wall of a stationary suction chamber 20, which is connected to a suction system in fluid communication with the conveyor housing 18 via a suction port 300 (FIG. 3) and capable of applying suction to the conveyor housing 18 via the suction port 300 so as to draw a continuous tobacco stream into engagement with the conveyor unit 17. According to various embodiments of the present invention, as shown in FIG. 3, the suction port 300 may be defined by a wear resistant portion or member 200 engaged with, coupled to, or otherwise integrally formed as part of a wall 18*a* of the conveyor housing 18. The wear resistant member 200 may be configured to resist wear from tobacco material or other particles (i.e., the heavier particles) drawn through the suction portion 300 by the suction system. The wear resistant member 200 may be comprised of various materials for resisting or otherwise reducing wear about the suction port 300, such as, for example, a hardened steel or a ceramic. In some instances, the wall 18*a* may be comprised of aluminum. In instances where the wear resistant member 200 is coupled to the wall 18*a* or conveyor housing 18, the wear resistant member 200 may include a plurality of fastener apertures 202 for receiving a corresponding plurality of fasteners (not shown) for fastening the wear resistant member 200 to the wall 18*a* or conveyor housing 18.

According to one embodiment, as shown in FIGS. 5A-5C, the wear resistant member 200 may have a substantially planar flange portion 204 extending laterally about one end of a channel portion 206 defining the suction port 300. In such an embodiment, the channel portion 206 extends into the wall 18*a* for coupling thereto. In other instances, the wear resistant member 200 may be integrally formed with the wall 18*a* or another portion of the conveyor housing 18. In this regard, the wear resistant member 200 may be essentially formed as a single-piece with the wall 18*a*. In some instances, the entire wall 18*a* or portions thereof may be comprised of a wear resistant material to form the wear resistant member 200.

In some instances, the suction system may include a suction generating device 71 (e.g., a fan) fluidly coupled to the conveyor housing 18 by a conduit 88. The rotor of the suction generating device 71 is driven by a motor 72 by a transmission 73 whose ratio is adjustable by a servomotor 83 to thereby vary the pressure in the suction chamber 20. The streamlets of air which flow upwardly through the lower reach of the conveyor unit 17 attract the ascending particles of tobacco in a stream building zone A wherein the particles form a growing tobacco stream which adheres to the underside of the lower reach of the conveyor unit 17 due to the provision of the suction chamber 18 and advances with the conveyor unit 17 along an elongated slightly downwardly sloping path in the tobacco material inlet duct 16 defined by the conveyor housing 18. The lower reach of the conveyor unit 17 comprises the end wall or top wall of the tobacco material inlet duct 16 whose width determines the width of the tobacco stream.

If desired, the pressure in the suction chamber 20 can be varied by an adjustable flow restrictor 86 which is installed in the conduit 88 between the suction generating device 71 and the outlet of the suction chamber 20 and whose setting can be adjusted by a suitable motor 87. In such apparatus, the RPM of the rotor of the suction generating device 71 can remain constant and the servomotor 83 is then used to adjust the flow restrictor 86 via motor 87 to thus determine the setting of the flow restrictor 86 and influences the pressure in the suction chamber 20. If the effective cross-sectional area of the flow restrictor 86 is increased, the pressure in the suction chamber 20 drops, and vice versa.

The apron conveyor device 9 has an endless belt 9*a* extending and movable about a plurality of apron roller members 9*b* for supplying tobacco material to the tobacco material inlet duct 16. Each apron roller member 9*b* extends between and is engaged with opposing side walls 150 (shown removed in FIG. 1) of the tobacco material supply housing 10*a* via respective apron channels 152, as shown in FIG. 6. That is, the apron roller members 9*b* are slidingly received within the apron channels 152 such that the endless belt 9*a* extends between the opposing side walls 150. A channel member 154 may be provided with each respective side wall 150, wherein the channel member 154 may define at least a portion of the apron channels 152. The channel member 154 may be comprised of a wear resistant material for resisting wear associated with forces (i.e., bearing thrust forces, imbalance forces, etc) imparted to the side walls 150 via the apron roller members 9*b*. That is, the apron roller members 9*b* interact with the side wall 150 about the apron channel 152 and can cause degradation or wearing thereof. Further, tobacco material moving throughout the tobacco rod making apparatus 100 may also interact with the apron conveyor device 9 and its components to create build-up thereon, which can further cause wear on the mechanically interacting parts or components of the apron conveyor device 9. As such, the channel member 154 may reduce instances of downtime for repair due to its wear resistant characteristics. For example, the channel member 154 may be comprised of hardened steel, ceramic, or any other suitable material for resisting wear. The channel member 154 may be engaged with, coupled to, or otherwise integrally formed as part of the respective side wall 150. In some instances, the channel member 154 may be essentially formed as a single-piece with the respective side wall 150. The side walls 150 may be typically comprised of aluminum, which can otherwise readily wear.

According to some embodiments, the side walls 150 may also define a plurality of bearing bores 156 for receiving the roller members of a conveyor unit or endless belt member. For example, as shown in FIG. 6, the bearing bores 156 may be configured to receive the ends of a plurality of roller members 5*a* of the endless belt conveyor unit 5 (FIG. 1) such that the roller members 5*a* extend between and are engaged with the bearing bores 156 associated with opposing side walls 150 of the tobacco material supply housing 10*a*. The bearing bores 156 may also experience a high amount of wear due to interaction with bearing members (not shown) received within the bearing bores 156 to facilitate rotation of the roller members 5*a*. Further, tobacco material build-up within the bearing bores 156 may also contribute to wear issues. As such, in order to reduce instances of downtime for repair of the tobacco supply unit 10, one or more bearing bores 156 may be fitted or otherwise integrally formed with a bearing support member 400 comprised of a wear resistant material for resisting wear associated with bearing forces imparted to the opposing side walls 150 via the roller members 5*a*.

According to one embodiment, as shown in FIGS. 5A and 5B, the bearing support member 400 may include a flange portion 402 and a channel portion 404 extending perpendicularly therefrom. The channel portion 404 may be received within the bearing bore 156 such that the flange portion 402 abuts and extends laterally against a face 158 of side wall 150. The channel portion 404 may define a bore 406 configured to receive the roller member 5*a* of the endless belt conveyor unit 5. The bearing support member 400 may be comprised of hardened steel, ceramic, or any other suitable material for resisting wear. The bearing support member 400 may be engaged with, coupled to, or otherwise integrally formed as part of the respective side wall 150. In some instances, the bearing support member 400 may be essentially formed as a single-piece with the respective side wall 150. In some instances, the bearing support member 400 may include a plurality of fastener apertures 408 for receiving a corresponding plurality of fasteners (not shown) for fastening the bearing support member 400 to the side wall 150 of the tobacco material supply housing 10*a*.

The speed of the conveyor 12 is sufficiently high to ensure that all particles of tobacco enter the stream building zone A wherein they form a growing stream which is attracted to the lower reach of the conveyor unit 17 as a result of the establishment of a pressure differential by the suction chamber 20. A trimming or equalizing device 19 is adjacent to the path of the tobacco stream downstream of the stream building zone A (in a second portion of the path for the tobacco stream, namely at a surplus removing station B) and includes two rotary tobacco clamping discs (not shown) cooperating with a rotating brush or paddle wheel to remove any and all tobacco particles which comprise the surplus and extend downwardly beyond a fixed equalizing plane.

The equalized tobacco stream (filler) may thereupon deposited on the upper side of an endless belt conveyor 24, and more particularly on a continuous web 21 of cigarette paper which is drawn off a reel 22 and is caused to pass through an imprinting device 23 serving to apply to spaced-apart portions of the web 21 information such as the trademark of the manufacturer, the name of the manufacturer, the brand name of the article and/or others. The speed of the web 21 on the conveyor 24 matches the speed of the filler and the web 21 is thereupon draped around the filler in a wrapping unit 26 in such a way that one marginal portion of the web extends tangentially of and away from the filler. The latter is compacted during passage through the wrapping mechanism 26 so that it forms a solid cylindrical rod. The outwardly extending marginal portion of the draped web 21 is coated with adhesive by a suitable paster (not shown) and is folded over the other marginal portion to form therewith a seam extending in parallelism with the axis of the resulting cigarette rod 28. The seam is heated or cooled by a tandem sealer 27, depending on the nature of adhesive paste. This ensures that the seam does not open during passage of the rod 28 through a rod-dividing unit 31 which subdivides the rod into plain cigarettes 32 of double unit length. The density of successive increments of the filler in the rod 28 may be monitored by a density monitoring device 29 which mounted in the frame F ahead of the cutoff 31.

The tobacco rods 32 form a single file and are engaged and transported by successive orbiting arms 33 of a transfer device 34 which deposits such cigarettes on a rotary drum-shaped conveyor unit 36 of the filter tipping apparatus 37, e.g., a machine known as MAX or MAX S (both manufactured by Hauni-Werke Körber & Co. KG). The filter tipping apparatus 37 comprises a rotary disc-shaped cutter 38 which subdivides each cigarette 32 into two coaxial plain cigarettes of unit length, and such cigarettes are thereupon assembled with filter rod sections to form filter cigarettes of unit length or double unit length.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for forming tobacco rod portions of a smoking article from tobacco material, the apparatus comprising:

a conveyor unit configured to receive a continuous stream of the tobacco material and to transport the continuous tobacco material stream along an elongate path for formation of the continuous tobacco material stream into a continuous tobacco rod;

a conveyor housing configured to house the conveyor unit, the conveyor housing defining a tobacco material inlet duct configured to receive the continuous tobacco material stream;

a suction system in fluid communication with the conveyor housing through a suction port, the suction system being configured to apply suction to the conveyor housing via the suction port, wherein the conveyor unit is disposed between the suction port and the tobacco material inlet duct, so as to draw the continuous tobacco material stream into engagement with the conveyor unit; and a wear resistant member operably engaged with a wall of the conveyor housing and defining the suction port, the wear resistant member being configured to resist wear from interaction with particles, associated with the continuous tobacco material stream, drawn through the suction port by the suction system.

2. An apparatus according to claim 1 wherein the wear resistant member comprises a substantially planar flange portion extending laterally about one end of a channel portion defining the suction port, the flange portion of the wear resistant member further defining a plurality of fastener apertures adapted to receive a corresponding plurality of fasteners for fastening the wear resistant member to the wall.

3. An apparatus according to claim 1 wherein the wear resistant member comprises one of a hardened steel and a ceramic.

4. An apparatus according to claim 1 wherein the wall comprises aluminum.

5. An apparatus according to claim 1 further comprising:

an apron conveyor device disposed adjacent to the tobacco material inlet duct defined by the conveyor housing, the tobacco material inlet duct being configured to receive the tobacco material therethrough for interaction with the conveyor unit, the apron conveyor device having an endless belt extending and movable about a plurality of apron roller members for supplying the tobacco material to the tobacco material inlet duct, each apron roller member extending between and operably engaged with opposing side walls of a tobacco material supply housing via respective apron channels; and a channel member operably engaged with each respective side wall and at least partially defining one of the apron channels, the channel member being configured to resist wear associated with forces imparted to the opposing side walls via the apron roller members.

6. An apparatus according to claim 5 wherein the channel member comprises one of a hardened steel and a ceramic.

7. An apparatus according to claim 5 wherein the opposing side walls comprise aluminum.

8. An apparatus according to claim 5 further comprising:

a tobacco supply unit configured to supply the tobacco material to the apron conveyor device, the tobacco supply unit having an endless belt member extending and movable about a plurality of roller members, each roller member extending between and operably engaged with bearing bores associated with opposing side walls of the tobacco material supply housing; and a plurality of bearing support members operably engaged with the opposing side walls and defining the bearing bores, the bearing support members being configured to resist wear associated with bearing forces imparted to the opposing side walls via the roller members.

9. An apparatus according to claim 8 wherein the bearing support members comprise one of a hardened steel and a ceramic.

10. An apparatus according to claim 1 further comprising:

a wrapping unit configured to receive the continuous tobacco material stream from the conveyor unit and to circumscribe the continuous tobacco material stream transported along the elongate path with a continuous supply of wrapping paper so as to form a continuous tobacco rod; and a rod-dividing unit configured to divide the continuous tobacco rod into a plurality of tobacco rod portions.

* * * * *